US008079455B2

(12) United States Patent
Böge et al.

(10) Patent No.: US 8,079,455 B2
(45) Date of Patent: Dec. 20, 2011

(54) ESCALATOR OR MOVING WALKWAY

(75) Inventors: Jens Böge, Barmstedt (DE); Frank Neerhut, Henstedt-Ulzburg (DE); Michael Tilkorn, Trittau (DE); Reiner Ludwig, Schwarwarzenbek (DE)

(73) Assignee: Thyssen Krupp Elevator Innovation Center S.A. (ES)

( * ) Notice: Subject to any disclaimer, the term of this patent is extended or adjusted under 35 U.S.C. 154(b) by 0 days.

(21) Appl. No.: 12/622,274

(22) Filed: Nov. 19, 2009

(65) Prior Publication Data

US 2010/0122889 A1 May 20, 2010

(30) Foreign Application Priority Data

Nov. 20, 2008 (DE) ..... 20 2008 015 410 U

(51) Int. Cl.
*B66B 23/14* (2006.01)

(52) U.S. Cl. ..... 198/329; 198/323

(58) Field of Classification Search ..... 198/329, 198/323

See application file for complete search history.

(56) References Cited

U.S. PATENT DOCUMENTS

| | | | | |
|---|---|---|---|---|
| 1,741,842 | A * | 12/1929 | Holtschmit | 198/329 |
| 3,419,127 | A * | 12/1968 | Yost | 198/329 |
| 4,576,276 | A * | 3/1986 | Boltrek et al. | 198/332 |
| 5,020,654 | A * | 6/1991 | Sansevero et al. | 198/328 |
| 6,832,678 | B2 * | 12/2004 | Ogura et al. | 198/322 |

FOREIGN PATENT DOCUMENTS

| | | |
|---|---|---|
| DE | 29809268 | 9/1998 |
| DE | 10322955 | 1/2004 |
| EP | 547737 A2 * | 6/1993 |

* cited by examiner

*Primary Examiner* — Mark A Deuble
(74) *Attorney, Agent, or Firm* — Robert W. Becker; Robert Becker & Assoc.

(57) ABSTRACT

An escalator or moving walkway having a frame, to which rails for chain rollers and rails for idling rollers are fixedly mounted, in particular with the aid of side panels, the escalator or moving walkway further comprising a turn-around area for the chains thereof that comprises a tensioning station for the chains. The tensioning station is guided and mounted on a side part that is fixedly mounted to the frame independently of the support structure.

11 Claims, 2 Drawing Sheets

ESCALATOR OR MOVING WALKWAY

The instant application should be granted the priority date of Nov. 20, 2008 the filing date of the corresponding German patent application 20 2008 015 410.3.

BACKGROUND OF THE INVENTION

The invention relates to an escalator or a moving walkway.

Escalators and moving walkways comprise tensioning chains at which step bands or pallet bands, respectively, rotate. The tensioning chains, indeed, are notedly stable and dimensioned to have sufficient safety margin, however, they are subject to wear resulting in an elongation of the chains.

Chain tensioning devices are generally known that are incorporated into the turn-around area of escalators and moving walkways in order to keep the chain in a tensioned condition also in the case of an undesired elongation thereof and that are intended to prevent the chain from coming off the chain wheels, and consequently preventing the steps or step run-in parts, respectively, from colliding with one another.

It has become known for quite a long time now, to employ safety switches that are to switch off the escalator in the case of the chain exceeding a given elongation.

An escalator of the this kind is known from German utility model DE-GM 298 09 268. With this approach, a safety switching for escalators is provided in which with the aid of a potentiometer or an optical sensor that responds to corresponding optical markers and triggers a calibrated cam switch, the monitoring of the chain tensioning device is to be achieved.

From DE 103 22 955 B4 an escalator is known that comprises a tensioning station for the step chain that is slidably mounted with respect to a frame of the escalator. The relative movement between a bearing carriage or slide and the frame is continuously detected with the aid of a position sensor. The position sensor subsequently outputs an analog output signal depending on the present position to an evaluation unit that serves to translate or convert the tension value detected into the respective elongation of the chain, that is to say the offset or displacement of the bearing carriage. The tensioning station comprises a pressure spring by means of which the step chain is kept under tension.

The escalators and moving walkways known so far, however, all exhibit the disadvantage that the tensioning station is accommodated and aligned on the support structure. Moreover, additional laterally arranged components for supporting and guiding the tensioning station are required with the approaches or solutions known so far. This leads to an increased amount of raw materials and supplies and to a time-consuming and cost-intensive installation.

The manufacturers of escalators and moving walkways, however, constantly make an effort to not only reduce the costs for installation, but also the costs of manufacture of escalators and moving walkways. Moreover, the competitive environment requires short delivery times for escalators and moving walkways and thus a production as fast as possible.

Therefore, it is the object of the invention to produce an escalator or moving walkway of the aforementioned general type that can be manufactured with a production expenditure as low as possible and cost-efficiently and that provides a simplified installation.

SUMMARY OF THE INVENTION

This object is inventively solved by an escalator or moving walkway that comprises a frame; rails for chain rollers and for idling rollers, with the rails being fixedly mounted on the frame; a side part as part of a turn-around area for chains of the escalator or moving walkway, wherein the side part is fixedly mounted on the frame; and a tensioning station for the chains, wherein the tensioning station is guided and mounted on the side part independently of a support structure.

An essential aspect of the invention is to integrate the tensioning station into the guiding system components and thus to reduce the complexity by decreasing the material inventory and aligning work.

According to the invention it is particularly favorable that the chain roller rails in the turn-around area of the escalator or the moving walkway are resiliently guided for maintaining the chain tension. In this case, the idling roller rails are fixed and are thus attached to rail components such as side panels that are connected to the frame of the escalator or moving walkway, respectively, in a stationary manner. The chain roller rails and thus the running surface of the chain rollers are designed to be flexible or movable between the side part that is fixedly mounted to the frame and the idling roller rails for tensioning the chain.

With the aid of the resilient configuration or design of the chain roller rails it is achieved that in the case of an occurrence of an elongation of the step chain or pallet chain, respectively, retensioning of the chains is feasible in a simple and space-saving manner. The tensioning station that is connected to the chain roller rails, is incorporated into lateral components, with the aid of which the rails of the escalator or moving walkway, respectively, are connected to the frame of the escalator or moving walkway, resulting in a substantial reduction of material usage or input.

Due to the fact that according to the invention only the chain roller rails are designed to be flexible for the tensioning thereof and the idling roller rails are fixedly connected to rail components such as side panels that are fixedly attached to the frame of the escalator or the moving walkway, respectively, the idling roller rails do not comprise breaks that could interfere with the running smoothness and safety.

Preferably, the chain roller rails are connected with components of a tensioning station that is slidably mounted with respect to the frame of the escalator or moving walkway. The weight and the tension forces as well as the horizontal and vertical guiding forces for alignment or orientation of the tensioning station are absorbed by the lateral components of the rails incorporating the tensioning station.

Preferably, the tensioning station is supported on the side part that is fixedly mounted to the frame, with the aid of a bearing, in particular a slide bearing. The slide bearing in this case is attached to a recess provided for the tensioning station in the side part that is fixedly mounted to the frame, thus providing for a compact configuration of the tensioning station.

It is particularly favorable that the tensioning station is formed such that it comprises a frame that is mounted on the slide bearing and to which the tension spring and a safety switch, in particular a trip cam switch, are connected for monitoring the elongation of step chains or pallet chains, respectively.

Preferably, the safety switch for monitoring the step chain elongation or pallet chain elongation, respectively, is mounted on the frame of the tensioning station such that the safety switch is displaced or shifted together with the chains when retensioning the chains. Thus, the subsequent adjustment of the switch position is unnecessary.

Advantageously, the tensioning station comprises a side part, to which the chain roller rail is attached whereas the side part is fixedly connected with the frame of the tensioning station. Therefore, when adjusting the tension force of the tension spring, both the side part of the tensioning station and the chain roller rail connected therewith are displaced or shifted as well, in order to retension the chains in the case of an elongation incurred.

Preferably, the chain roller rail is provided with laterally attached journals or pins that are designed to position the chain roller rail on the side part of the tensioning station. The side part of the tensioning station comprises corresponding recesses into which the journals engage upon attachment of the chain roller rail to the side part. In this way, the installation of the flexible chain roller rail and the connection of the chain roller rail with the tensioning station are implemented in a simple manner.

According to a further, also favorable embodiment, the components of the tensioning station are permanently connected to one another and are preferably joined by laser welding. The shaping of the individual parts is preferably effected by laser cutting.

BRIEF DESCRIPTION OF THE DRAWINGS

Further advantages, details and features emerge from the following description of an exemplary embodiment with reference to the drawings, in which.

DESCRIPTION OF SPECIFIC EMBODIMENTS

Figure 1:
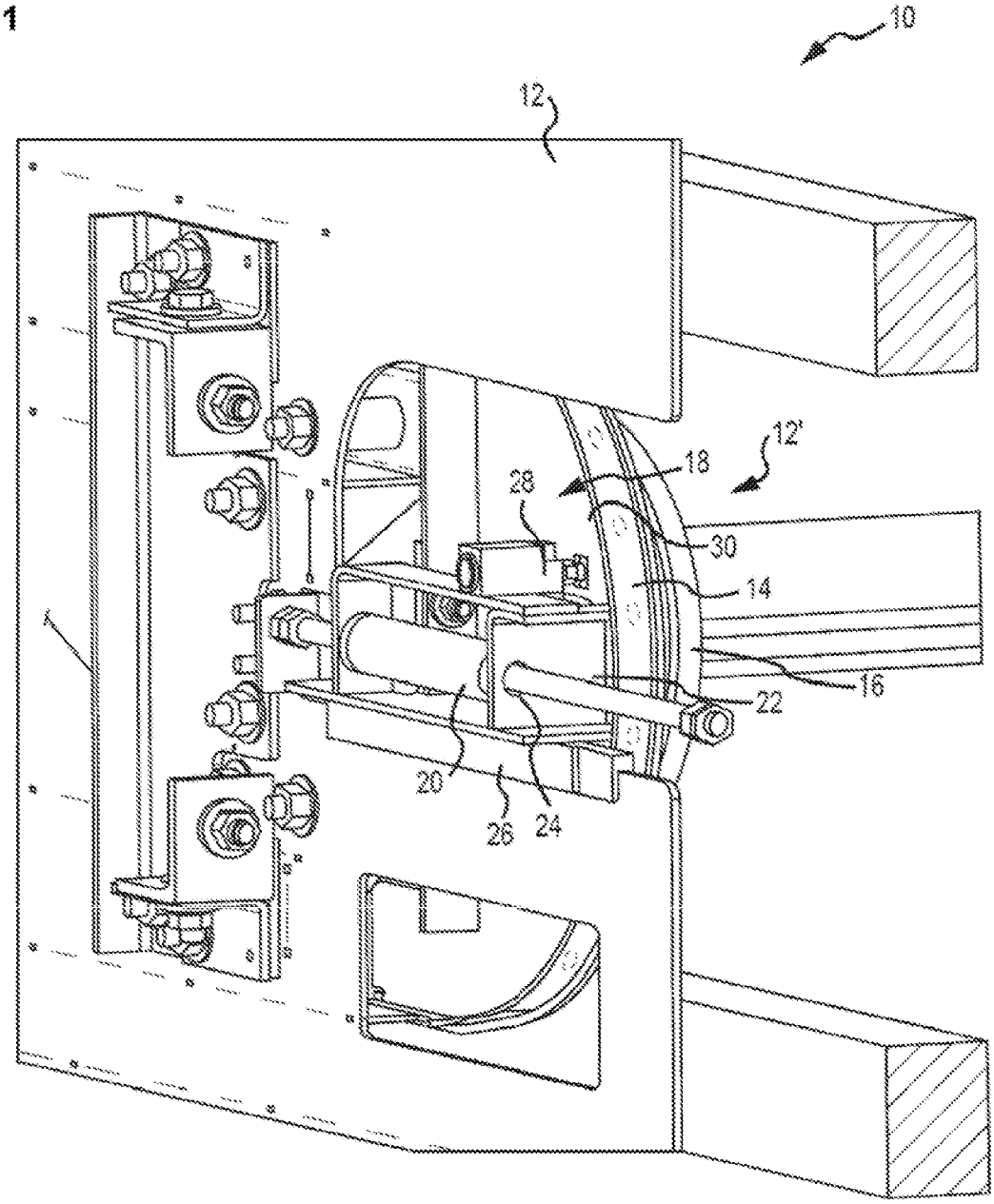
FIG. 1 illustrates a perspective exterior view of a side part for chain roller rails and idling roller rails according to an embodiment of an inventive escalator or an inventive moving walkway, said side part being fixedly mounted to the frame and incorporating a tensioning station.
Figure 2:
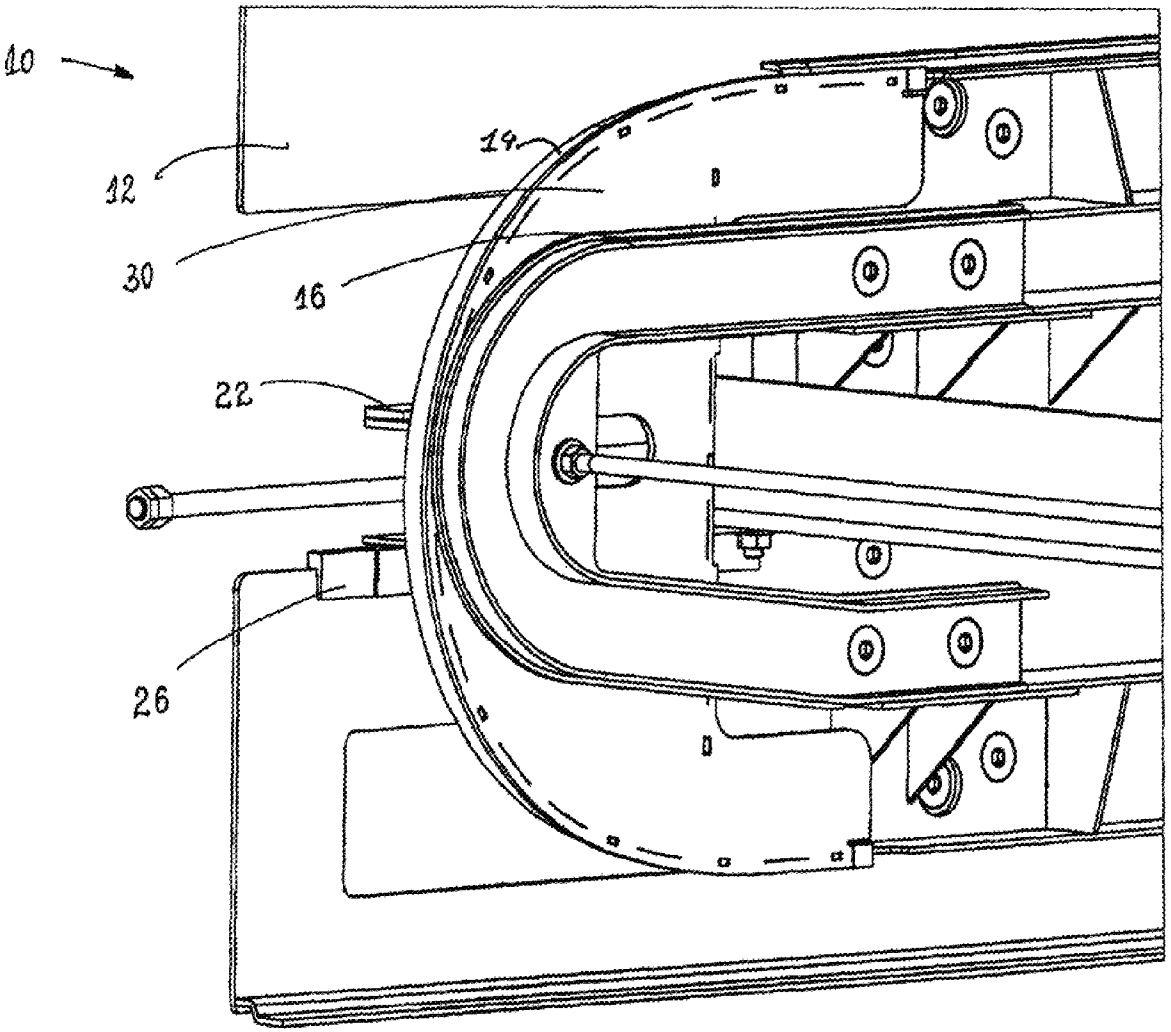
FIG. 2 illustrates a perspective interior view of a side part for chain roller rails and idling roller rails according to an embodiment of an inventive escalator or an inventive moving walkway, said side part being fixedly mounted to the frame and incorporating a tensioning station.

Like reference numerals in the FIGS. 1 and 2 indicate like or corresponding components such that a detailed explanation is dispensable.

FIG. 1 illustrates a perspective exterior view of a turn-around or direction reversal area 10 of an escalator or moving walkway. The turn-around area 10 comprises a side part 12 that is attached to a frame (not shown) and to which chain roller rails 14 and idling roller rails 16 for chain rollers and idling rollers (not shown) for escalator steps or moving walkway panels are attached. The side part 12 is formed as a side panel.

The side part 12 comprises a recess 12' in which a tensioning station 18 is arranged. The side part 12 is elongated to such an extent that it is capable of accommodating the tensioning station. Thus, an accommodation and alignment of the tensioning station at the support structure of the escalator or the moving walkway is superfluous.

The tensioning station 18 comprises a tension spring 20, one end of which butts against the side part 12 which is fixedly connected to the frame, whereas the other end of the tension spring 20 freely extends from the recess 12' of the side part 12 in the longitudinal direction such that the tension force can be set.

The mounting of the tensioning station 18 is effected on a slide bearing 26 attached to the side part 12 fixed to the frame in the region of the recess 12'.

The frame 22 of the tensioning station 18 is permanently connected to a side part 30 on its rail-sided part. The individual parts of the tensioning station 18 are joined with the aid of high-precision joining methods, in particular laser welding, wherein the shaping or forming operation of the individual parts is preferably effected by laser cutting.

As shown in FIG. 2, the side part 30 of the tensioning station 18 is connected to the chain roller rail 14 and is configured such that is follows the track or run of the chain roller rail in the turn-around or direction-changing area. In the case of occurrence of a chain elongation, the tension force of the tension spring is adapted to the elongation. In order to retension the chain, the running surface of the chain rollers exclusively is designed to be flexible according to the invention.

Journals (not shown) are provided at the chain roller rails 14 for positioning the chain roller rail 14 on the side part 30 of the tensioning station 18, said journals engaging in recesses formed in the side part 30 during the joining process.

In contrast, as is apparent in FIG. 2, the idling roller rails 16 are fixedly connected to the side part 12 fixedly mounted to the frame for guiding and holding down the idling rollers, and do not have any breaks that could interfere with the running smoothness and safety thereof.

A trip cam or safety switch 28 is provided for monitoring the step chain elongation or panel chain elongation, respectively. As apparent in FIG. 1, the cam switch 28 is flexibly or movably mounted on the frame 22 of the tensioning station 18, such that in the case of retensioning the chains, the switch is displaced as well. Thus, a subsequent adjustment of the switch position is unnecessary.

In the case of a detected chain elongation that, however, is within an acceptable range, the staircase is switched off such that the maintenance staff can compensate for this elongation by retensioning the tension spring 20. In the case of an occurrence of a larger elongation of the chain, the danger exists that the step chain comes off the chain wheels. Then a stop signal is output that switches off the escalator or moving walkway.

The specification incorporates by reference the disclosure of German priority document 20 2008 015 410.3 filed Nov. 20, 2009.

The present invention is, of course, in no way restricted to the specific disclosure of the specification and drawings, but also encompasses any modifications within the scope of the appended claims.

What we claim is:

1. An escalator or moving walkway, comprising:

a frame;

rails for chain rollers and for idling rollers, wherein said rails for said idling rollers are fixedly mounted on said frame;

a side part as part of a turn-around area for chains of said escalator or moving walkway, wherein said side part is fixedly mounted on said frame, wherein said side part is formed by a side panel; and a tensioning station for the chains, wherein said tensioning station is integrated into the side panel within a recess.

2. An escalator or moving walkway according to claim 1, wherein said tensioning station is provided with a tension spring that abuts against said side part that is fixedly mounted on said frame.

3. An escalator or moving walkway according to claim 2, which further comprises a bearing, wherein said tensioning station is mounted on said side part that is fixedly mounted on said frame via said bearing.

4. An escalator or moving walkway according to claim 3, wherein said bearing is a slide bearing.

5. An escalator or moving walkway according to claim 3, wherein said tensioning station is provided with a frame with which said tension spring and a safety switch are connected for monitoring of elongation of a step chain or a pallet chain.

6. An escalator or moving walkway according to claim 5, wherein said safety switch is a trip cam switch.

7. An escalator or moving walkway according to claim 5, wherein said safety switch is disposed in such a way that it is also shifted along during a retensioning of the chains via said tensioning station and therefore does not have to be readjusted.

8. An escalator or moving walkway according to claim 1, wherein said tensioning station is provided with a side part, and wherein said rail for chain rollers is provided with laterally attached pins for positioning of said chain roller rail in corresponding recesses of said side part of said tensioning station.

9. An escalator or moving walkway according to claim 1, wherein components of said tensioning station are fixedly connected to one another.

10. An escalator or moving walkway according to claim 9, wherein the components of said tensioning station are joined by laser welding.

11. An escalator or moving walkway according to claim 1, wherein in said turn-around area, between idling roller rails fixedly mounted on said frame and said side part that is fixedly mounted on said frame, said chain roller rails are resiliently guided to maintain chain tension.

* * * * *